United States Patent [19]

Baltisberger

[11] Patent Number: 4,569,488

[45] Date of Patent: Feb. 11, 1986

[54] METHOD OF, AND APPARATUS FOR, PROCESSING TWO PRODUCT FORMATIONS, EACH FORMED BY SUBSTANTIALLY FLAT PRODUCTS, ESPECIALLY PRINTED PRODUCTS

[75] Inventor: Erich Baltisberger, Hinwil, Switzerland

[73] Assignee: Ferag AG, Hinwil, Switzerland

[21] Appl. No.: 464,597

[22] Filed: Feb. 7, 1983

[30] Foreign Application Priority Data

Feb. 15, 1982 [CH] Switzerland ..... 915/82

[51] Int. Cl.[4] ..... B65H 39/06; B65H 75/00

[52] U.S. Cl. ..... 242/59; 53/118; 198/347; 198/423; 270/52

[58] Field of Search ..... 242/59, 55, 67.3 R, 242/55.2, 56.5; 53/118, 430; 198/347, 423, 479; 270/52, 54, 56, 52.5; 271/151, 202, 216, 303; 226/76

[56] References Cited

U.S. PATENT DOCUMENTS

| | | | |
|---|---|---|---|
| 411,193 | 9/1889 | Hicks | 270/52 |
| 2,325,400 | 7/1943 | Hoover | 242/67.3 R X |
| 3,955,667 | 5/1976 | Müller et al. | 198/479 X |

FOREIGN PATENT DOCUMENTS

| | | | |
|---|---|---|---|
| 2417614 | 10/1975 | Fed. Rep. of Germany . | |
| 2518372 | 12/1975 | Fed. Rep. of Germany | 271/151 |
| 559691 | 3/1975 | Switzerland | 53/118 |
| 1061146 | 3/1967 | United Kingdom . | |
| 1398550 | 6/1975 | United Kingdom . | |
| 1572143 | 7/1980 | United Kingdom . | |
| 2092557 | 2/1981 | United Kingdom | 242/59 |

*Primary Examiner*—Stuart S. Levy
*Assistant Examiner*—Katherine Matecki
*Attorney, Agent, or Firm*—Werner W. Kleeman

[57] ABSTRACT

The two product formations lying in superimposed fashion at a lateral offset are conveyed by a transport device towards a separation or detaching element. The printed products of the first product formation lying at the top marginally protrude at one side thereof past the printed products of the second product formation lying at the bottom. A deflecting part or element of the separation element is arranged in the travel path of the protruding marginal portions of the printed products of the first product formation. The deflecting part or element extends transversely with respect to the travel path. The printed products of the second product formation lying at the bottom run past the deflecting part or element without being acted upon by the latter and are outfed by a first outfeed conveyor. The printed products of the top situated product formation contact the deflecting part or element at their protruding marginal portion and are deflected upwardly and lifted from the printed products of the bottom situated product formation. The up-lifted printed products are outfed by a second outfeed conveyor.

21 Claims, 6 Drawing Figures

Fig.3
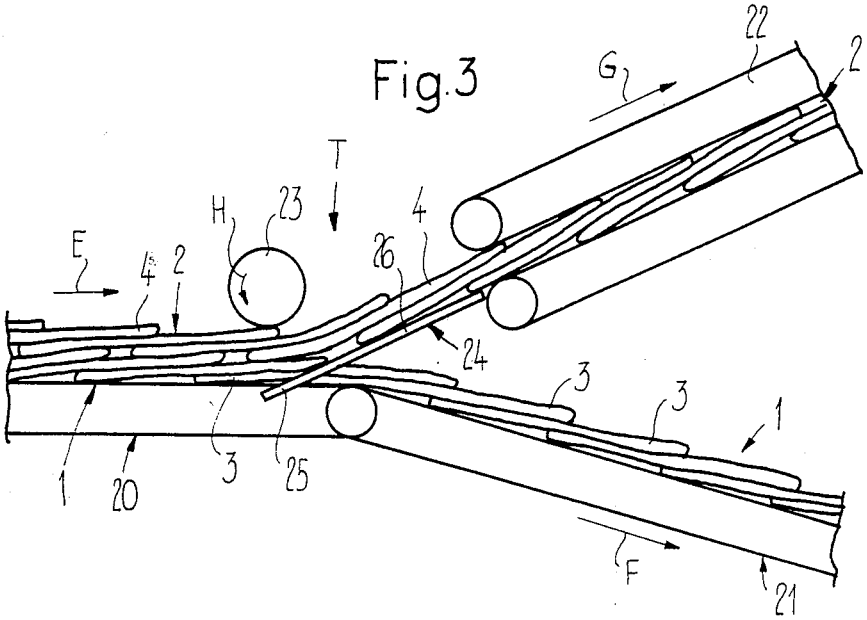
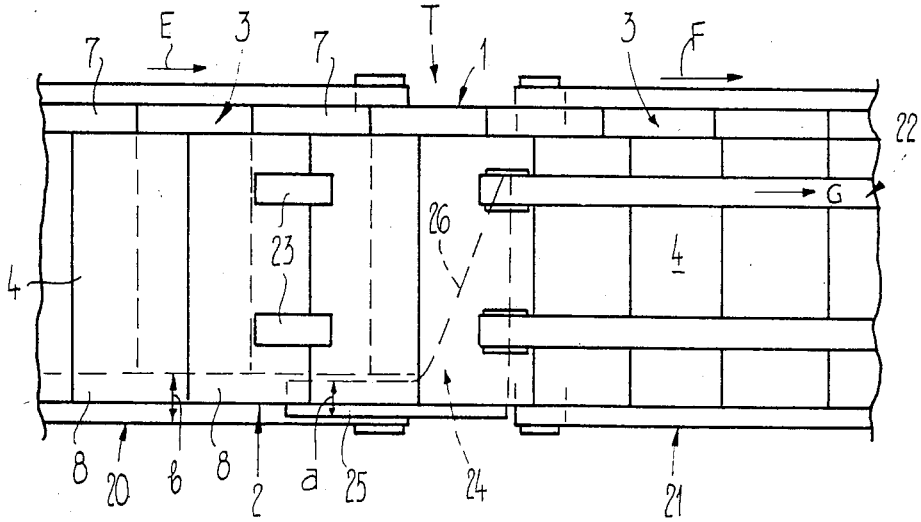
Fig.4

METHOD OF, AND APPARATUS FOR, PROCESSING TWO PRODUCT FORMATIONS, EACH FORMED BY SUBSTANTIALLY FLAT PRODUCTS, ESPECIALLY PRINTED PRODUCTS

CROSS-REFERENCE TO RELATED APPLICATIONS

This application is related to (i) the commonly assigned, copending U.S. application Ser. No. 06/280,998, filed July 6, 1981, entitled "APPARATUS FOR STACKING PRINTED PRODUCTS, SUCH AS NEWSPAPERS, PERIODICALS AND THE LIKE, ARRIVING IN AN IMBRICATED PRODUCT STREAM", now U.S. Pat. No. 4,438,618, granted Mar. 27, 1984; (ii) the commonly assigned, copending U.S. application Ser. No. 06/338,568, filed Jan. 11, 1982, entitled "METHOD AND APPARATUS FOR THE LONG-TERM PRESSING OF PRINTED PRODUCTS, ESPECIALLY NEWSPAPERS", now U.S. Pat. No. 4,494,359; (iii) the commonly assigned, copending U.S. application Ser. No. 06/432,557, filed Oct. 4, 1982, entitled "APPARATUS FOR THE STORAGE OF FLAT PRODUCTS ARRIVING IN AN IMBRICATED FORMATION, ESPECIALLY PRINTED PRODUCTS"; (iv) the commonly assigned, copending U.S. application Ser. No. 06/445,565, filed Nov. 29, 1982, entitled "METHOD AND APPARATUS FOR STORING CONTINUOUSLY ARRIVING FLAT PRODUCTS, ESPECIALLY PRINTED PRODUCTS, AND PRODUCT PACKAGE FORMED FROM SUCH PRODUCTS"; (v) the commonly assigned, copending U.S. application Ser. No. 06/445,564, filed Nov. 29, 1982, entitled "METHOD OF, AND APPARATUS FOR, REMOVING FLAT PRODUCTS, ESPECIALLY PRINTED PRODUCTS, FROM A WINDING CORE", now U.S. Pat. No. 4,525,982; and (vi) the commonly assigned, copending U.S. application Ser. No. 06/441,955, filed Nov. 15, 1982, entitled "METHOD AND APPARATUS FOR OPENING MULTI-SHEET PRODUCTS, ESPECIALLY PRINTED PRODUCTS", now U.S. Pat. No. 4,486,011 .

BACKGROUND OF THE INVENTION

The present invention relates to a new and improved method of, and apparatus for, processing two continuously arriving elongate product formations formed by flat products, especially printed products, and, more specifically, concerns the processing of two elongate product formations which continuously arrive, preferably in an imbricated product formation.

At times throughout this disclosure reference to such method and apparatus will simply generally be made in terms of measures for accomplishing such processing of the printed products. Equally, while the description to follow, as a matter of convenience, refers to the processing of printed products, obviously other types of products can be conveniently handled, and thus, reference to the processing of printed products is not be be construed in a limiting sense in any way whatsoever, rather is merely to be viewed as an exemplary and desirable field of application for the inventive measures.

SUMMARY OF THE INVENTION

Therefore, with the foregoing in mind it is a primary object of the present invention to provide an improved method of, and apparatus for, processing such product formations in a highly reliably and essentially trouble-free manner.

Another and more specific object of the present invention aims at the provision of a new and improved method of, and apparatus for, processing continuously arriving, elongate product formations formed by substantially flat products, especially printed products, which enables the processing to be done with the smallest possible expense and equipment expenditure.

A further significant object of the present invention is directed to a new and improved method of, and apparatus for, processing two continuously arriving, elongate product formations formed by substantially flat products, which apparatus is relatively simple in construction and design, quite economical to manufacture, extremely easy to use, and not readily subject to breakdown or malfunction.

Now in order to implement these and still further objects of the invention, which will become more readily apparent as the description proceeds, the method of the present development is manifested by the features that, the two product formations are superimposed or placed upon one another in the direction of their longitudinal extension or extent such that marginal portions of the products of a first product formation protrude laterally pastover over the products of a second product formation, the laterally protruding marginal portions of said products of said first product formation thereafter being acted upon in order to separate the two product formations by lifting the products of the first product formation from the products of the second product formation.

As already indicated the invention also is directed to an improved construction of apparatus for performing the inventive method. The apparatus of the present development is manifested by the features that, two infeed means are provided, each serving for feeding a respective one of the two product formations. The infeed means are arranged relative to each other such that the two product formations can be superimposed or placed upon one another such that the products of a first one of these two product formations laterally protrude past the products of the second one of these two product formations.

According to another apparatus aspect of the invention, wherein the two product formations are superimposed at a lateral off-set, marginal portions of the products of the first product formation protrude laterally past the products of the second product formation, and separating or detaching means are arranged to act upon the laterally protruding marginal portions of the products of the first product formation, in order to lift the same from the products of the second product formation.

The two product formations, after being joined, may be conjointly further processed, for example, by winding-up the same upon a winding core. The separation of the superimposed product formations, which is required at a later stage of the processing operation, can be performed in a simple manner, because the products of the first product formation include marginal portions which protrude past the products of the second product formation. This enables the products of the first product formation to be effectively lifted from the products of the second product formation by using the separation or detaching means acting upon the protruding marginal portions, in order to thus separate the product formations. After product separation, the separated product formations can be further processed separately from each other in any desired manner.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIGS. 3 and 4 show a side view and a top plan view, respectively, of the separating or detaching means for separating the two superimposed product formations of printed products in the apparatus shown in FIG. 1;

DETAILED DESCRIPTION OF THE PREFERRED EMBODIMENTS

Figure 1:
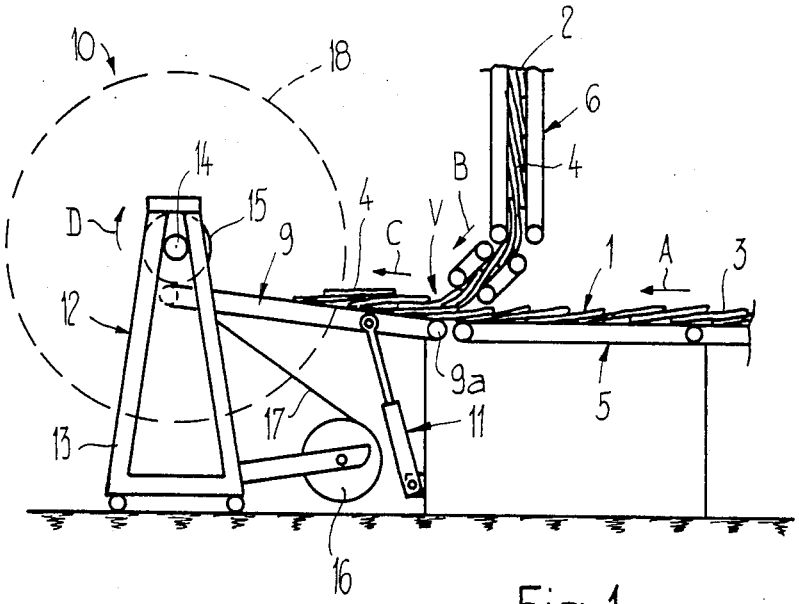
FIG. 1 is a side view of an apparatus for joining together two product formations of printed products.
Figure 2:
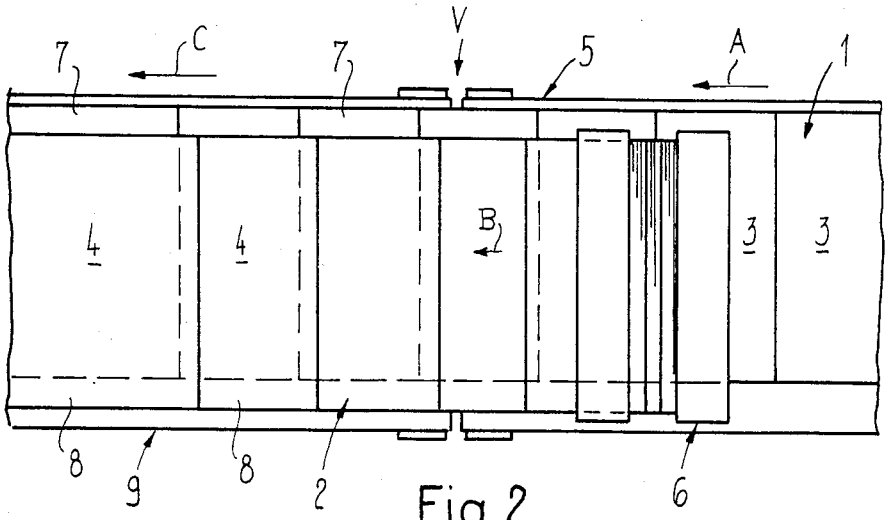
FIG. 2 is a top plan view, on an enlarged scale, of the apparatus shown in FIG. 1.

Describing now the drawings, it is to be understood that in order to simplify the illustration only enough of the construction of the apparatus has been shown as needed for those skilled in the art to readily understand the underlying principles and concepts of the present invention. Turning now specifically to FIGS. 1 and 2, there has been illustrated therein an exemplary embodiment of apparatus by means of which two product formations 1 and 2 are joined and, subsequently, are conjointly wound-up. Each of the two product formations 1 and 2 is, for instance, formed by continuously arriving printed products 3 and 4, respectively, like, for example, newspapers, periodicals, journals and the like, which overlap to form an imbricated product formation. The imbricated product formations 1 and 2 may originate from any suitable product source. Preferably, however, the product formation 1 originates from an intermediate product package which is the subject of and has been described in detail in the aforementioned commonly assigned, copending U.S. application Ser. No. 06/445,565, filed Nov. 29, 1982, entitled "Method and Apparatus for Storing Continuously Arriving Flat Products, Especially Printed Products, and Product Package formed from such Products", to which reference may be readily had and the disclosure of which is incorporated herein by reference.

Each of the two product formations 1 and 2 composed of printed products is supplied to a product joining or uniting location V by related infeed or conveying means 5 and 6, respectively, at which joining location V the two product formations 1 and 2 are joined together or united. The infeed or conveying means 5 and 6 may be of any suitable type and may, for example, be constituted by conveyor belts. As will be evident particularly from FIG. 2, the infeed or conveying means 5 and 6 are arranged above one another such that their conveying directions A and B extend essentially in parallel with respect to each other at the region of the joining or uniting location V and such that the two product formations 1 and 2 are superimposed upon one another with a lateral off-set. The lateral off-set between the two product formations 1 and 2 is with respect to their longitudinal extension or extent, and has the consequence that the printed products 3 of the one product formation 1, which hereinafter will be conveniently called the second product formation, and the printed products 4 of the other product formation 2, which hereinafter will be conveniently called the first product formation, each protrude laterally by means of their marginal portions or sections 7 and 8, respectively, past the printed products of the other product formation, as has been clearly shown in FIG. 2.

The product formations 1 and 2 which are superimposed or lying upon one another with a lateral off-set are conducted to a wind-up station 10 by conveying means 9 which follow the infeed means 5. The conveying means 9 may be constituted by a conveyor belt rocker or balance which is rotationally journaled at one end 9*a* thereof. A pressing or contact mechanism 11 comprising a loaded spring or spring storage acts upon the conveying means 9.

A winding-up and storage apparatus 12, which is the subject of and has been described in detail in the aforementioned commonly assigned, copending U.S. application Ser. No. 06/432,557, filed Oct. 4, 1982, entitled "Apparatus for the Storage of Flat Products Arriving in an imbricated Formation, especially Printed Products", is located at the wind-up station 10. This winding-up and storage apparatus 12 comprises a mobile frame or frame unit 13 forming a bearing block or pedestal or equivalent structure. A shaft 14 of a winding core 15 is rotationally journaled or mounted in the mobile frame 13. The winding core 15 is arranged to be rotationally driven in the direction of the arrow D. Furthermore, a delivery or supply spool 16 containing a winding band or tape 17 is rotationally journaled or mounted in the mobile frame 13. The winding band or tape 17 consists of a tension-resistant material like, for example, a suitable plastics material. One end thereof is fixedly connected to the winding core 15. Upon rotation of the winding core 15 the winding band or tape 17 is withdrawn from the delivery spool 16 and appropriate means, which are not here particularly shown, like, for example, a brake, are provided to keep the winding band or tape 17 under tension as it is wound upon the winding core 15.

The superimposed product formations 1 and 2 are supplied to the winding core 15 by the conveying means 9 in the conveying direction C thereof, which extends substantially parallel to the conveying direction A of the infeed means 5, and are wound-up upon the winding core 15, as such has been described in detail in the aforementioned commonly assigned, copending U.S. application Ser. No. 06/445,565, filed Nov. 29, 1982. The wound-up package is shown in broken lines and conveniently designated by reference numeral 18.

The package 18, however, serves just for the intermediate storage of the printed products 3 and 4. This implies, that the printed products 3, 4 will be withdrawn for further processing from the package 18 at a later point in time. If further processing, for example, is accomplished in the manner as has been described in detail in the aforementioned commonly assigned, copending U.S. application Ser. No. 06/445,564, filed Nov. 29, 1982, entitled "Method of, and Apparatus for, Removing Flat Products, Especially Printed Products, from a Winding Core", then the two product formations 1 and 2 will again have to be separated from each other. The separation procedure will be explained hereinafter in detail with reference to FIGS. 3 and 4.

The product formations 1 and 2 are unwound in the manner as has been described in detail in the aforementioned, commonly assigned, copending U.S. application Ser. No. 06/445,564, filed Nov. 29, 1982 and are then supplied in the direction E to a separating station T by suitable transport means 20 which, for example, may be constituted by a conveyor belt. Two further conveyors 21 and 22 follow the transport means 20 after the separating station T. The conveying directions thereof are designated by reference characters F and G, respectively, and extend substantially parallel to the transport direction E of the transport means 20 in the top plan view of FIG. 4. The first and second conveyors or outfeed means 21 and 22 also can be formed by conveyor belts. At the region of the separating or separation station T two pressing and conveying rollers 23, acting upon the printed products 4 of the first product formation 2 which lies on the top, are arranged above the transport means 20 and are rotationally driven in the direction of the arrow H.

Stationary separating or detaching means in the form of a separating or detaching element 24 are disposed in the travel path of the two superimposed product formations 1 and 2 at the separating or separation station T. The separating or detaching element 24 may, for example, consist of sheet metal or metal plating and comprises a deflecting part or element 25 which is arranged in the travel path of the protruding marginal portions or sections 8 of the printed products 4 of the first product formation 2, which lies on the top. This deflecting part or element 25 extends transversely with respect to such travel path and piercingly extends through the same as clearly shown in FIG. 3. As seen in the travel directions E and G, respectively, of the first product formation 2 a support means or portion 26 follows the deflecting element 25 and is formed integrally therewith. The deflecting part or element 25 has a width a which is smaller than the width b of the protruding marginal portions 8 of the printed products 4, as shown in FIG. 4. It is, of course, possible to also design the deflecting part or element 25 with a greater width, however, this deflecting part or element 25 may not extend into the travel path of the printed products 3 of the second product formation 1 which lies at the bottom. The support means or portion 26 has a greater width than the deflecting part or element 25 and serves to support the printed products 4 of the first product formation 2 which have been lifted from the printed products 3 of the second product formation 1.

The product separating process is accomplished as follows:

The superimposed product formations or streams 1 and 2 are moved towards the separating or detaching element 24 of the separating or detaching means by the transport means 20. Due to the lateral off-set of the two product formations 1 and 2 the printed products 4 of the upper first product formation 2 run-up with their protruding marginal portions 8 upon the deflecting part or element 25 which is at an inclined position, while the printed products 3 of the lower second product formation 1 lying thereunder travel past the separating or detaching element 24 without being acted upon by the latter, in order to reach the first conveyor 21 which outfeeds or leads the same away therefrom. By running-up onto the deflecting part or element 25 the printed products 4 of the upper or top product formation 2 are deflected upwardly, and thus, are lifted-off from the printed products 3 of the lower second product formation 1. While moving further in the direction of the arrow G, which movement is augmented by the rollers 23, the printed products 4, which at first rest upon the deflecting part or element 25 only with their marginal portions or sections 8, will gradually come to bear or rest upon the support portion or means 26 throughout the largest part of their width (see FIG. 4). Subsequently, the printed products 4 are taken over by the second outfeed conveyor 22 and are led away.

Separation of the two superimposed product formations 1 and 2 composed of the respective printed products 3 and 4 thus can be accomplished without difficulty by the simply designed separating or detaching element 24. However, it is a precondition therefor that the printed products 4 of the one product formation 1 protrude at one side past the printed products 3 of the other product formation 2. This, however, also may be ensured in a simple manner by appropriately superimposing or placing upon one another the product formations 1 and 2 while they are joined together as has been described hereinbefore with reference to FIGS. 1 and 2.

Further processing of the printed products 3 and 4 of the respective two product formations 1 and 2, then, can be accomplished independently of each other in any suitable manner. Preferably, however, further processing is accomplished in the manner as described in detail in the aforementioned commonly assigned, copending U.S. application Ser. No. 06/445,564, filed Nov. 29, 1982, according to which the first product formation 2 of printed products 4 is wound-up in order to form an intermediate winding package.

Separation of the two superimposed product formations 1 and 2 also may be accomplished in the manner as described hereinbefore, by causing an appropriately designed separating or detaching element to act upon the protruding marginal portions 7 of the printed products 3 in the second product formation 1 lying at the bottom. In such case the outfeed conveyors 21 and 22 will have to be designed in a different suitable manner.

Although in the embodiment as shown and described the printed products 3 and 4 of the product formations 1 and 2, respectively, protrude laterally beyond the printed products of the respective other product formation, the separation operation only requires that the printed products of one product formation protrude laterally past the printed products of the other product formation.

Separation of the two superimposed product formations may still be accomplished with other means than the means described hereinbefore. Some possible variant constructions will be referred to hereinbelow.

To assist the forward movement of the printed products 4 which have run-up onto the deflecting part or element 25, a conveyor belt may be arranged above the deflecting element 25 and opposite thereof relative to the travel path of the protruding marginal portions 8 of the printed products 4. This conveyor belt engages the printed products 4 at their protruding marginal portions 8 and moves the same towards the second outfeed conveyor 22.

Instead of the deflecting part or element 25 a conveyor belt may be provided which, like the deflecting element 25, is disposed in the path of travel of the protruding marginal portions 8 and extends transversely with respect to the travel path. This conveyor belt entrains the printed products 4 running-up thereon with their protruding marginal portions 8 and conveys the same towards the second outfeed conveyor 22. Support means 26 also may be connected after such first conveyor belt. As described hereinbefore, a second conveyor belt may be provided opposite the first conveyor belt relative to the travel path of the protruding marginal portions 8. In such case, therefore, the protruding marginal portions or sections 8 of the printed products 4 are engaged by the conveyor belts at both sides of the printed products 4.

Furthermore, it is conceivable to provide engaging and transport means for separating the product formations 1 and 2, in place of the separating or detaching means illustrated and described hereinbefore. Such engaging and transport means seizes the printed products 4 at their protruding marginal portions 8 at the separating location or station T, lifts the same off from the printed products 3 of the second product formation 1 and advances the same further. Such engaging and transport means have been illustrated purely schematically in FIGS. 5 and 6 and have been designated by reference numeral 27. This engaging and transport means 27 comprises a guide channel or passage 28 in which extends a mobile traction means 29 like, for example, a chain link belt containing ball-and-socket joints of known construction. Brackets or overhang arms 30 each carrying a claw or gripper 31 (see FIG. 6) are mounted at regular intervals along the traction means or element 29. Each claw or gripper unit 31 comprises a fixed clamping jaw 32 formed integrally with the related bracket or 30 as well as a movable clamping jaw 33 which is mounted for pivoting about an axis or pivot shaft 34 on the bracket 30 or the fixed clamping jaw 32, respectively. The movable clamping jaw 33 is designed to possess a substantially L-shape configuration and carries at one end thereof a clamping roller or roll 35 and, at the other or opposite end thereof, a follower member 36 like, for example, a roller. The movable clamping jaw 33 is held in the closed position by means of a spring 37 or equivalent structure. At the region of the separating location or station T there are provided suitable and thus not here fully shown cams which serve to open the claws or gripper units 31. The follower members 36 of the movable clamping jaws 33 run-up upon the cams while passing the same, whereby these movable clamping jaws 33 are pivoted into the open position against the force of the related spring 37.

Figure 5:
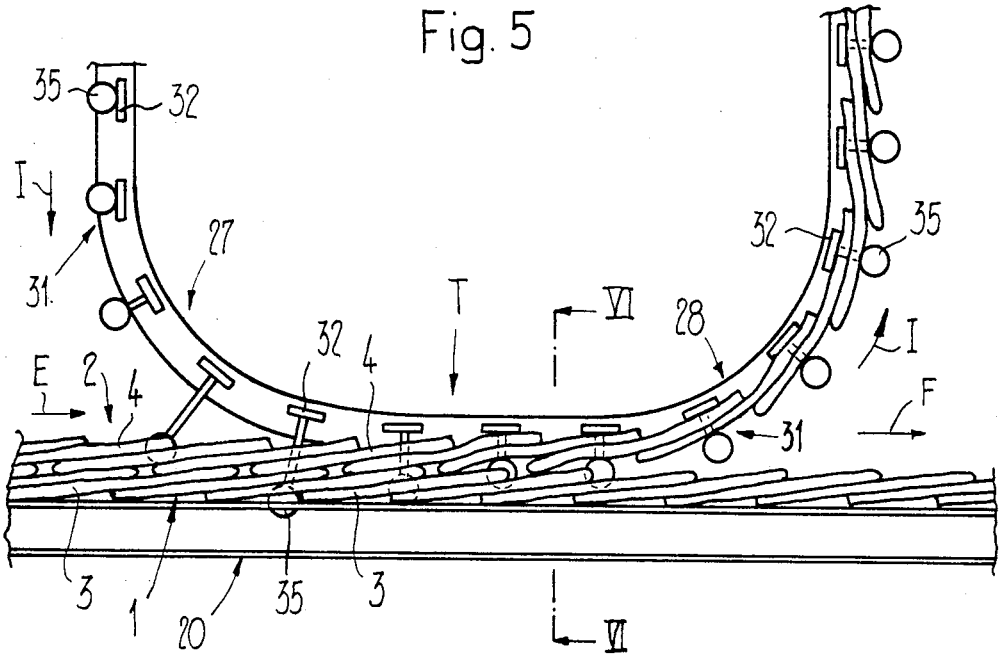
FIG. 5 is a side view of another embodiment of the separating or detaching means for separating two superimposed product formations of printed products in the apparatus according to the invention.
Figure 6:
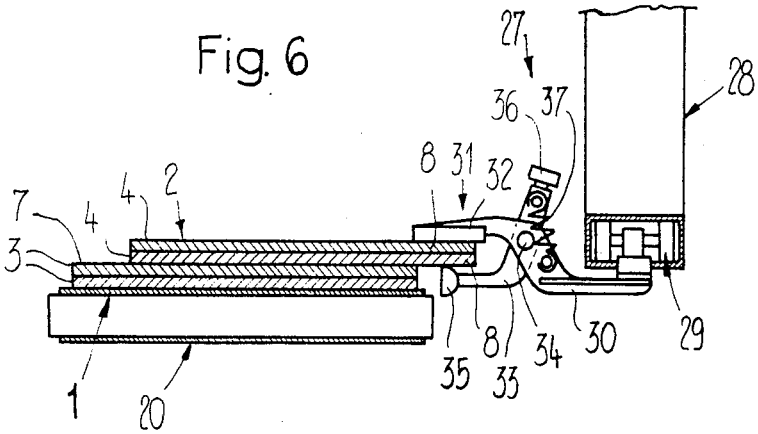
FIG. 6 is a sectional view taken substantially along the line VI—VI of FIG. 5.

As will be particularly evident from FIG. 5, the claws or grippers 31 moving in the direction of the arrow I towards the separating location or station T will be opened in the manner described hereinbefore. At the separating location or station T the initially still open and, then, closing jaws 31 seize the printed products 4 of the first product formation 2, which lie on the top, at their protruding marginal portions or sections 8. After the separating location or station T, as seen in the conveying direction I, the engaging and transport means 27 extend upwardly, i.e. away from the transport means 20 which lead away the lower-lying second product formation 1 of printed products 3 in the direction of the arrow F. Thus, the first product formation 2 is lifted off from the second product formation 1 by the engaging and transport means 27.

With respect to its structure and mode of operation the engaging and transport means 27 corresponds to the conveyor structure as described in U.S. Pat. No. 4,062,537 which, however, contrary to the engaging and transport means 27 engages the printed products at both lateral edges or margins. Since the printed products 3 of the second product formation 1 essentially have the same width as the printed products 4 of the first product formation 2, a lateral off-set of the two product formations 1, 2, as described, is required in order to expose the printed products of the one product formation at their marginal regions or edges. When, however, the products of the one product formation are less wide than the printed products of the other product formation, then the product formations are not necessarily required to be laterally off-set when superimposed or placed upon one another. In this case, the wider printed products of the one product formation will laterally protrude past the narrower printed products of the other product formation, even when their central longitudinal axes are aligned, which thus will enable the separation to be accomplished in the manner described hereinbefore.

Reference is further made to the fact that a separation of the superimposed product formations in the manner as described hereinbefore also will be possible when the printed products or, respectively, other flat products, are not overlapping in an imbricated product formation.

While it has been described with reference to FIGS. 1 and 2 that the two superimposed product formations 1 and 2 are wound-up to form a winding or wound package, the two product formations 1 and 2, of course, also may be conjointly processed in a different manner as, for example, by conjointly conveying the same over a longer distance and then separating the same again in the manner described.

While there are shown and described present preferred embodiments of the invention, it is to be distinctly understood that the invention is not limited thereto, but may be otherwise variously embodied and practiced within the scope of the following claims. ACCORDINGLY,

I claim:

1. A method of processing two elongate product formations, each formed from a number of individual, continuously arriving substantially flat products, especially printed products which are not connected to one another, comprising the steps of:

superimposing said two product formations in the direction of their longitudinal extent such that marginal portions of said products of a first one of said two product formations protrude laterally with regard to a longitudinal axis of the two product formations past said products of a second one of said two product formations; and acting upon said laterally protruding marginal portions of said products of said first product formation in order to separate said two product formations by lifting said products of said first product formation from said products of said second product formation.

2. The method as defined in claim 1, further including the step of:

supplying said products of each formation continuously in an imbricated formation.

3. The method as defined in claim 1, further including the step of:

superimposing said two product formations while laterally off-setting said two product formations from each other.

4. The method as defined in claim 1, further including the steps of:

moving said product formations for separating the same relative to and past deflecting means in said direction of their longitudinal extent; and said deflecting means acting upon said laterally protruding marginal portions of said products of said first product formation.

5. The method as defined in claim 1, further including the step of:

seizing said laterally protruding marginal portions of said products of said first product formation by a conveying device in order to separate said product formations.

6. The method as defined in claim 1, further including the step of:

conjointly winding-up said two superimposed product formations.

7. The method as defined in claim 1, further including the step of:

winding-up one of said two product formations after separating the same.

8. An apparatus for processing two superposed elongate product formations formed from a number of imbricate, individual, continuously arriving, substantially flat products, especially printed products which are not connected to one another, comprising:

two product infeed means, each for feeding a respective one of said two product formations; and said product infeed means include means for superposing said two product formations upon one another in the direction of their longitudinal extent such that said products of a first one of said two product formations protrude laterally with respect to the direction of feeding past said products of a second one of said two product formations to an extent sufficient to enable contact of the thus formed laterally protruding portions of the first one of said two product formations by detaching means so as to permit subsequent separation of said first and second product formations from one another.

9. The apparatus as defined in claim 8, wherein:

said product infeed means are arranged relative to and above each other such that said two product formations are superimposed with lateral off-set.

10. The apparatus as defined in claim 8, further including:

conveying means for supplying said two superimposed product formations to a wind-up station.

11. An apparatus for processing two superposed elongate product formations, each of which comprises a continuous stream of imbricate, individual, continuously arriving in a direction of travel, substantially flat products, especially printed products which are not connected to one another, wherein said products of a first one of said two product formations are superimposed upon said products of a second one of said two product formations such that marginal portions of said products of said first product formation protrude laterally with regard to the direction of travel of the two product formations past said products of said second product formation, and comprising:

detaching means arranged to act upon said marginal portions of said products of said first product formation in order to lift the same from said products of said second product formation; and transport means for conveying said two superposed elongate product formations to said detaching means and for conveying away from the detaching means said products of the second formation after the products of the first formation have been lifted from the products of the second formation.

12. The apparatus as defined in claim 11, wherein:

said products are superimposed upon one another with lateral off-set.

13. The apparatus as defined in claim 11, wherein:

said detaching means comprise engaging and transport means for engaging said products of said first product formation at said protruding marginal portions thereof.

14. The apparatus as defined in claim 11, further including:

a winding-up station; and conveying means for supplying one of said two product formations, after separating the same, to said winding-up station.

15. An apparatus for processing two elongate product formations formed from a number of individual, continuously arriving, substantially flat products, especially printed products which are not connected to one another, wherein said products of a first one of said two product formations are superimposed upon said products of a second one of said two product formations such that marginal portions of said products of said first product formation protrude laterally with regard to a longitudinal axis of the two product formations past said products of said second product formation, comprising:

detaching means arranged to act upon said marginal portions of said products of said first product formation in order to lift the same from said products of said second product formation;

said marginal portions of said products of said first product formation moving along a predetermined travel path;

said detaching means comprising a deflecting element arranged in said travel path and extending transversely relative thereto; and said deflecting element deflecting said products of said first product formation which come into contact with the deflection element at said marginal portions of said products of said first product formation.

16. The apparatus as defined in claim 15, wherein:

said deflecting element is stationary; and transport means for transporting said two superimposed product formations towards said deflecting element.

17. The apparatus as defined in claim 16, further including:

support means arranged following said deflecting element in the direction of movement of the deflected one of said two product formations; and said products of said deflected product formation bearing upon said support means.

18. The apparatus as defined in claim 15, further including:

support means arranged following said deflecting element in the direction of movement of the deflected one of said two product formations; and said products of said deflected product formation bearing upon said support means.

19. The apparatus as defined in claim 15, wherein:

said deflecting element is formed by a first conveyor belt.

20. The apparatus as defined in claim 19, further including:

a second conveyor belt; and said second conveyor belt being arranged opposite said first conveyor belt forming said deflecting element with respect to said travel path of said protruding marginal portions in order to engage said protruding marginal portions of said products in their deflected state on both sides thereof.

21. An apparatus for processing two continuously arriving, elongate product formations formed from substantially flat products, especially printed products, wherein said products of a first one of said two product formations are superimposed upon said products of a second one of said two product formations such that marginal portions of said products of said first product formation protrude laterally past said products of said second product formation comprising:

detaching means arranged to act upon said marginal portions of said products of said first product formation in order to lift the same from said products of said second product formation;

said marginal portions of said products of said first product formation moving along a predetermined travel path;

said detaching means comprising a deflecting element arranged in said travel path and extending transversely relative thereto;

said deflecting element deflecting said products of said first product formation running-up on to the deflecting element at said marginal portions thereof;

said deflecting element being formed by a first conveyor belt;

a second conveyor belt; and said second conveyor belt being arranged opposite said first conveyor belt forming said deflecting element with respect to said travel path of said protruding marginal portions in order to engage said protruding marginal portions of said products in their deflected state on both sides thereof.

* * * * *